US008469590B2

(12) United States Patent
Yoo

(10) Patent No.: US 8,469,590 B2
(45) Date of Patent: Jun. 25, 2013

(54) SPECIAL HANDSTRAP FOR CASUAL OPEN-BAGS

(76) Inventor: Jin-Kul Yoo, Seoul (KR)

( * ) Notice: Subject to any disclaimer, the term of this patent is extended or adjusted under 35 U.S.C. 154(b) by 420 days.

(21) Appl. No.: 12/746,690

(22) PCT Filed: Nov. 24, 2008

(86) PCT No.: PCT/KR2008/006918

§ 371 (c)(1),
(2), (4) Date: Jun. 7, 2010

(87) PCT Pub. No.: WO2009/078595

PCT Pub. Date: Jun. 25, 2009

(65) Prior Publication Data

US 2010/0251516 A1 Oct. 7, 2010

(30) Foreign Application Priority Data

Dec. 18, 2007 (KR) ..... 10-2007-0133810

(51) Int. Cl.
*B65D 33/06* (2006.01)
*B65D 33/28* (2006.01)

(52) U.S. Cl.
USPC ..... 383/26; 383/76

(58) Field of Classification Search
USPC ..... 383/26, 27, 14, 25, 29, 18, 76, 2, 383/20, 72, 17
See application file for complete search history.

(56) References Cited

U.S. PATENT DOCUMENTS

| | | | | |
|---|---|---|---|---|
| 1,124,925 | A * | 1/1915 | Low | 383/18 |
| 1,805,810 | A * | 5/1931 | Deubener | 383/20 |
| D576,793 | S * | 9/2008 | Norsa | D3/234 |

FOREIGN PATENT DOCUMENTS

| | | | |
|---|---|---|---|
| JP | 56-080716 U | | 6/1981 |
| JP | 57-188650 U | | 11/1982 |
| JP | 1-179521 U | | 12/1989 |
| JP | 11342954 A | * | 12/1999 |
| KR | 20-0431664 Y1 | | 11/2006 |

OTHER PUBLICATIONS

International Search Report, Jul. 21, 2009, from International Phase of the instant application.

* cited by examiner

*Primary Examiner* — Jes F Pascua
(74) *Attorney, Agent, or Firm* — Jackson Patent Law Office

(57) ABSTRACT

This product is an invented Handstrap (loop) for Casual Open-Bag. As the present invention is not composed by the two separated handstraps (loop), but by a single strap that goes through all four punctures forming the bag straps, firstly 1) in the production process of shopping bags, the current 2 strap×2 knots=4 knots formation can be reduced to 1 strap×2 knots=2 knots not only allowing for decrease in labor costs, but the ends are processed through a mechanized treatment instead of manual labor, productivity can also be increased, 2) for the convenience of the transporting person, the straps may be adjusted to be longer or shorter, furthermore, 3) as the opening of the carrying bag is closed, not only cosmetically is it aesthetically improved, but the risk of losing the contents decrease. 4) Both endings of the strap are knotted like an coat string for good aesthetics, 5) pulling both (or one of the) sides will automatically function fastening device such as a hook-button on one or both sides, playing the role of theft prevention, 6) depending on the transporter's needs, the bag can be worn on the shoulders with one handstrap instead of two, and it is the new special handstrap for casual open bags applicable to all carrying bags (shopping bags included).

3 Claims, 2 Drawing Sheets

SPECIAL HANDSTRAP FOR CASUAL OPEN-BAGS

TECHNICAL FIELD

The present invention, special handstrap for casual open bags, as previously described in the abstract, was formed, with a single strap in order to resolve the problems and inconveniences of the current handstraps composed by two separated cords (strings), and relates to the new handstrap invented to reinforce the fixed inconvenience and security of two-sided handstrap strings.

BACKGROUND ART

The present invention relates to the new "special handstrap for casual open bags" that increases security of shopping bags, that are made out of paper and used mainly for promotional purposes, and casual style leather bags including carrying bags used to carry everyday products, that do not have fastening device such as zippers, hook-buttons, as a fastening device is formed rather conveniently and simply by handstraps of the open bag in their state of open entryway.

Generally, the current shopping bags or casual style simple carrying leather bags, in which shopping goods or contents are placed and carried, two handstraps, each connected to two holes (endings) which are knotted at four holes on both sides or attached by sewing so that it is used as two individual handstraps being held. Therefore, there were many inconveniences such as: 1) during carrying, since the entry part of the bag cannot be closed, the contents inside it or the goods in the shopping bag are exposed to be seen from the outside, especially 2) when placed on the floor, the open entry of the bag cannot be closed, there is a high risk of loss of the exposed valuable shopping goods, sometimes 3) if by mistake only one handstrap is lifted, the shopping bag is destroyed or the contents inside pour out, and also 4) while bags are being carried, their handstraps could be not be adjusted to the weight of the transported material or transporter's height.

DISCLOSURE

Technical Problem

Generally, the current shopping bags or casual style simple carrying leather bags, when which shopping goods or contents are placed in them and carried, been used so far with two handstraps with one each side, containing many inconveniences such as: 1) during carrying, since the entry part of the bag cannot be closed, the contents inside it or the goods in the shopping bag are exposed to be seen from the outside, especially 2) when placed on the floor, the open entry of the bag cannot be closed, there is a high risk of loss of the exposed valuable shopping goods, sometimes 3) if by mistake only one handstrap is lifted, the shopping bag is destroyed or the contents inside pour out, and also 4) while bags are being carried, their handstraps could be not be adjusted to the weight of the transported material or transporter's height.

Technical Solution

The present invention forms two loop shaped handstraps with one single cord that passes through the four holes (or four contact points) of both sides. Having the handstrap loop coming out from the inside, it is a new invention that solves the shortcomings of handstrap in current bags.

Therefore, regarding handstraps of open carrying bags, it has been newly changed through the building in of a connection method that, allowing a fastening device to form (see 'A' and 'B' in drawing) through the handstrap (cord) itself and allowing adjustments to shorter or longer according to discretion, the thing formed by a single connected string (see 'CD' in drawing), when going through between the string holes, passes from the inside of the present carrying bag (bag).

Advantageous Effects

1) In the production process of shopping bags, the current 2 strap×2 knots=4 knots formation can be reduced to 1 strap×2 knots=2 knots not only allowing for decrease in labor costs, but the ends are processed through a mechanized treatment instead of manual labor, productivity can also be increased, 2) for the convenience of the transporting person, the straps may be adjusted to be longer or shorter, furthermore, 3) as the opening of the carrying bag is closed, not only cosmetically, but the risk of losing the contents decrease. 4) Both endings of the strap are knotted like an coat string for good aesthetics, 5) pulling both (or one of the) sides will automatically function fastening device such as a hook-button on one or both sides, playing the role of theft prevention, 6) depending on the transporter's needs, the bag can be worn on the shoulders with one handstrap instead of two, and it is the new special handstrap for casual open bags applicable to all carrying bags (shopping bags included).

DESCRIPTION OF DRAWINGS

'Drawing 1' is the 'three dimensional figure' of the state where the single strap: 'ⓐ' is inserted in a general paper shopping bag, and 'Drawing 2' is 'three dimensional figure' of the state where the handstrap single strap: 'ⓐ' is inserted into a carrying bag.

'Drawing 3' and 'Drawing 4' are "three dimensional figures" showing the possible state of carrying bags being transported, as both ends of the single strap: 'ⓐ' of 'drawing 1' and 'drawing 2' are pulled to form the desired adequate size and tied in shape of coat string, and when handstraps ('c' and 'd') are pulled up, they become the fastening device ('A' and 'B') automatically.

Figure 1:
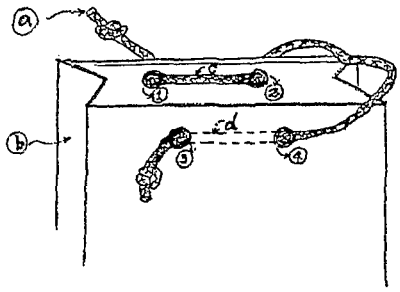
Figure 2:
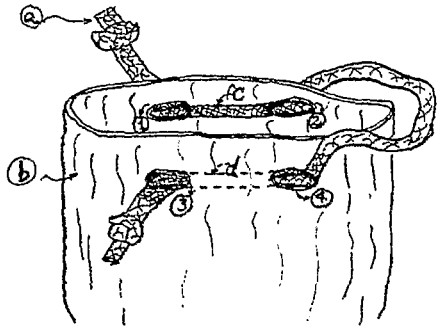
Figure 3:
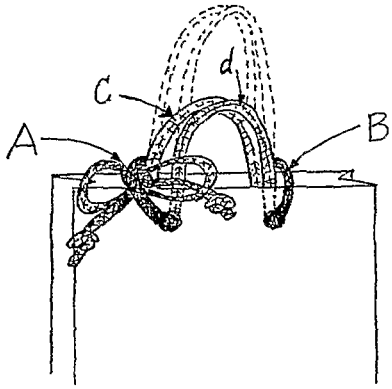
Figure 4:
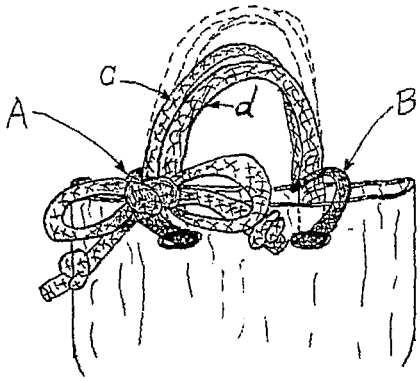
Figure 5:
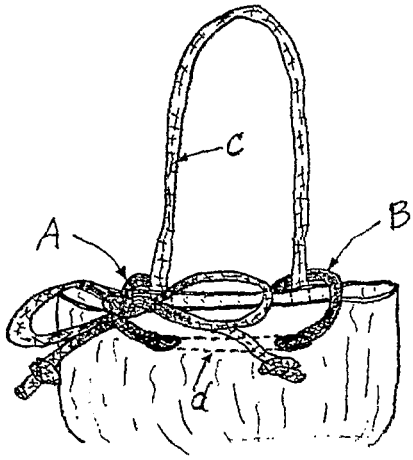
Figure 6:
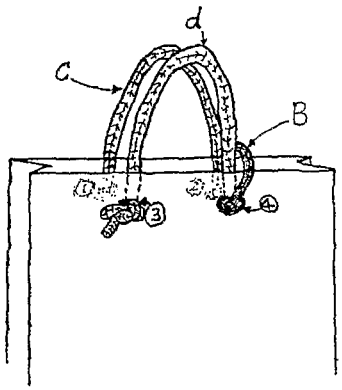

'Drawing 5' is the "three dimensional figure" showing the condition in which one of the handstraps and of the 'drawing 3' and 'drawing 4' are being pulled, so that the bag can be transported by hanging it on the shoulder as part of one handstrap being pulled to a greater length.

'Drawing 6' is the "three dimensional figure" of the state, in cases other than articles of value or weighty material, both endings of the strap: 'ⓐ' are left without being tied, cord's: 'ⓐ' endings are hooked in knots at '①' and '③' respectively, and the fastening device is automatically formed the one side (1 place) 'B'.

MODE FOR INVENTION

Referring to the drawing below, the advisable execution example is explained. As execution examples of the resulting "special handstrap for casual open bags" of this invention, "drawing 1" and "drawing 2" shows as "Execution—example 1," while not pulling this invention's handstraps, the multi-layer shopping bags generally called "shopping bags" made out of paper material and produced largely as promotional material and "Drawing 2" shows, as "Execution—example 2," casual-style carrying bags (leather bag), with the current handstraps formed by two cords, one that passes through '①' and '②' and another through '③' and '④', and have been used by attaching two separated handstraps.

The invention "Special Handstrap," as shown in "Drawing 1" or "Drawing 2" is composed by two handstraps (cord) by one single cord that passes through holes '①, ②, ③, ④'

Thus, if one cord: 'ⓐ' is passed consecutively through holes '①, ②, ③, ④' of bag (bag) 'ⓑ' as shown in 'Drawing 1' and 'Drawing 2,' both sides (ends of strap-hole 'ⓑ1' and '③') of cord: 'ⓐ' pulled up and tied in the shape of coat string to form handstraps (2 loops: 'c' and 'd'), the fastening device ('A' and 'B') is formed automatically as shown in "Drawing 3" and "Drawing 4", and at this point, it is adjusted by tightening or loosening both ends so that the two loops of the handstrap ('c' and 'd') two loops are made bigger or smaller.

On the other hand, as shown on "drawing 5," if one strap ('c' or 'd') from the two loops ('c' and 'd') is pulled up, it may be slipped on the bag's (bag) owner, more belongings or weighty objects may be easily transported together.

Also, in cases other than articles of value or weighty material, as shown in 'drawing 6,' the ending of the strap: 'ⓐ' are left without being knot in the form of coat string, strap: 'ⓐ' endings are hooked in knots in '①' and '③' respectively, and the fastening device is automatically formed the one side (1 place) 'B'.

INDUSTRIAL APPLICABILITY

As the present invention is not composed by the two separated handstraps (loop), but by a single strap that goes through all four punctures forming the bag straps, firstly, in the production process of shopping bags, the current 2 strap×2 knots=4 knots formation can be reduced to 1 strap×2 knots=2 knots not only allowing for decrease in labor costs, but the ends are processed through a mechanized treatment instead of manual labor, productivity can also be increased.

The invention claimed is:

1. An apparatus comprising:

a carrying bag, the carrying bag defining an interior, a major opening between the interior and an exterior, a first strap-hole, a second strap-hole, a third strap-hole opposing the second strap-hole, and a fourth strap-hole opposing the first strap-hole; and a cord, the cord including a first segment extending from the exterior through the first strap-hole into the interior, a second segment, contiguous to the first segment, a third segment, contiguous to the second segment, extending from the interior through the second strap-hole into the exterior, a fourth segment, contiguous to the third segment, extending from the exterior through the third strap-hole into the interior, a fifth segment, contiguous to the fourth segment, the fifth segment extending from the interior through the major opening into the exterior and from the exterior through the major opening into the interior, and a sixth segment, contiguous to the fifth segment, the sixth segment extending from the interior though the fourth strap-hole into the exterior, wherein a point on the fifth segment has a distance from the carrying bag greater than that of any point on the first, third, fourth, or sixth segments.

2. The apparatus according to claim 1 wherein the second segment extends from the interior through the major opening into the exterior and from the exterior through the major opening into the interior.

3. The apparatus according to claim 1 wherein the fourth segment traverses the major opening.

* * * * *